United States Patent [19]

Helmer

[11] Patent Number: 4,799,675

[45] Date of Patent: Jan. 24, 1989

[54] ARM LOCKING DEVICE FOR WEIGHTLIFTERS

[76] Inventor: George L. Helmer, 4129 Claudia Ave., Rosemead, Calif. 91770

[21] Appl. No.: 35,394

[22] Filed: Apr. 7, 1987

[51] Int. Cl.[4] ..... A63B 13/00

[52] U.S. Cl. ..... 272/123; 128/870; 273/189 R

[58] Field of Search ..... 272/93, 123, 143, 119; 128/78, 134, DIG. 15; 273/188 R, 189 R, DIG. 30

[56] References Cited

U.S. PATENT DOCUMENTS

| | | | |
|---|---|---|---|
| 1,699,219 | 1/1929 | Bemish et al. | 272/189 R |
| 1,969,314 | 8/1934 | Millett et al. | 128/134 |
| 2,425,489 | 8/1947 | Peterson | 273/189 R |
| 3,324,851 | 6/1967 | Posner | 272/189 R X |
| 3,724,846 | 4/1973 | Pierrine | 272/123 X |
| 3,797,483 | 3/1974 | Feldman | 128/DIG. 15 X |
| 3,872,860 | 3/1975 | Noblitt | 128/DIG. 15 X |
| 4,609,188 | 9/1986 | Lind | 272/93 |
| 4,629,183 | 12/1986 | Pierrine | 272/123 |
| 4,632,389 | 12/1986 | Moss | 272/119 |
| 4,672,722 | 6/1987 | Malamed | 128/DIG. 15 X |
| 4,685,668 | 8/1987 | Newlin, Jr. | 272/123 |
| 4,691,924 | 9/1987 | Strong | 273/189 R |

FOREIGN PATENT DOCUMENTS

| | | | |
|---|---|---|---|
| 20463 | of 1907 | United Kingdom | 273/189 R |
| 281171 | 12/1927 | United Kingdom | 273/189 R |

*Primary Examiner*—Richard J. Apley
*Assistant Examiner*—Robert V. Bahr
*Attorney, Agent, or Firm*—Christie, Parker & Hale

[57] ABSTRACT

An arm locking device for weightlifters is worn when performing weightlifting exercises primarily for the biceps to eliminate cheating by keeping the elbows close to the body. The arm locking device includes an elongated flexible and foldable axially stiff continuous strap having a central region for resting on the chest of the weightlifter and right and left end portions for wrapping around the biceps regions of the weightlifter's left and right arms. An adjustable neck strap assists holding the central portion of the strap on the chest during use. Opposite left and right end portions of the strap extend behind the triceps and the over the biceps regions of the left and right arms, respectively. Frictional fasteners on the free ends of the straps are then fastened to cooperating frictional fasteners on the central portion of the strap which overlies the chest region of the weightlifter. The ends of the straps are fastened tightly to lock the arms close to the body. The arm locking device keeps the elbows locked close to the body when performing arm exercises such as curls to eliminate cheating to enhance the benefits of a variety of arm exercises.

9 Claims, 2 Drawing Sheets

ARM LOCKING DEVICE FOR WEIGHTLIFTERS

FIELD OF THE INVENTION

This invention relates to weightlifting, and more particularly to an arm locking device worn during weightlifting exercises to enhance the benefits of certain arm exercises.

BACKGROUND OF THE INVENTION

In recent years, weightlifting has become a popular and useful means of physical exercise, not only for bodybuilders, but also athletes involved in man other sports. These include professional and college athletes who use weightlifting exercises for building strength and for physical conditioning. Football and basketball players and track and field athletes perform a variety of weightlifting exercises to keep in top shape. Football players especially use certain specific weightlifting exercises to build mass as well as strength. With the recent emphasis on weightlifting as a useful means of exercise and physical conditioning, a variety of lifting devices have been developed for isolating the effects that the weightlifting has on the body so as to magnify the intensity of each exercise. In this way, strength or mass can be developed for the particular muscle groups more effectively and in a shorter amount of time.

One such weightlifting device is used by weightlifters performing arm exercises for the biceps, such as curls. This device includes a curved rigid bar made of metal or plastic which fits over the weightlifter's chest. The bar is held in place by an adjustable neck band. The ends of the bar extend outwardly from opposite sides of the body, behind the elbows. The back portions of the weightlifter's arms (the triceps regions of the upper arms) rest against the ends of the rigid bar. The ends of the bar can have a slight curvature to conform to the back of the arms to hold them in place, spaced apart from the sides of the body during use. When performing weightlifting exercises such as curls, the ends of the rigid bar act as a restraint to resist the forces applied during the exercise. This device attempts to keep the arms in place and eliminate cheating which can occur if the elbows drift away from the sides of the body and thereby make it easier to lift the weight. By preventing cheating, the effect of the lifting exercise is isolated on the biceps and helps develop these muscles faster. These previous arm locking devices suffer from several disadvantages. The wide rigid bar which fits over the lifter's chest digs into the chest when the ends of the bar resist the force of the weight during use. This causes painful pinching of the skin and uncomfortable pressures on the front of the chest. In addition, the lifter's arms often are not constantly held in place on the ends of the rigid bar. There is a tendency for the elbows to move outwardly when performing weightlifting exercises such as curls, and they can slip off the ends of the bar. This device also is not designed well for use by women.

The present invention provides an arm locking device for weightlifters which overcomes the disadvantages of the prior arm locking device and which also provides additional improvements in accomplishing the desired results of certain arm exercises.

SUMMARY OF THE INVENTION

Briefly, one embodiment of this invention provides an arm locking device for use by weightlifters which includes an elongated flexible and foldable strap which is substantially non-stretchable in its axially dimension. The strap has a central portion for overlying the chest region of a weightlifter; a left end portion long enough to wrap around the left arm of the weightlifter by extending between the chest and left elbow, behind the left triceps and over the left biceps and then to an overlapping position on the central portion of the strap; and a right end portion long enough to wrap around the right arm of the weightlifter by extending between the chest and right elbow, behind the right triceps and over the right biceps and then to an overlapping position on the central portion of the strap. Fastening means on the central portion of the strap are attached to cooperating left and right fastening means on the left and right ends of the strap for holding the left and right end portions of the strap in fixed positions wrapped around the left and right arms of the weightlifter. The strap being wrapped around the left and right arms of the lifter in this way holds the left and right arms of the weightlifter in a locked position with the fastened ends of the strap keeping the elbows of the left and right arms in close contact with the sides of the body, by resisting outward movement of the left and right arms during weightlifting exercises.

The flexibility of the strap makes it possible to perform weightlifting exercises such as curls without creating any resistance to the normal lifting action, and the ends of the strap being wrapped around the lifter's biceps cooperate with the force of the weight being lifted to naturally resist any tendency of the elbows to drift away from the body during use. The strap can be adjusted to hold the arms in contact with the sides of the body during use. As a result, the effect of the weightlifting exercises can be isolated on specific muscle groups and the result of the weightlifting exercise is enhanced.

DETAILED DESCRIPTION

Figures 1, 2:
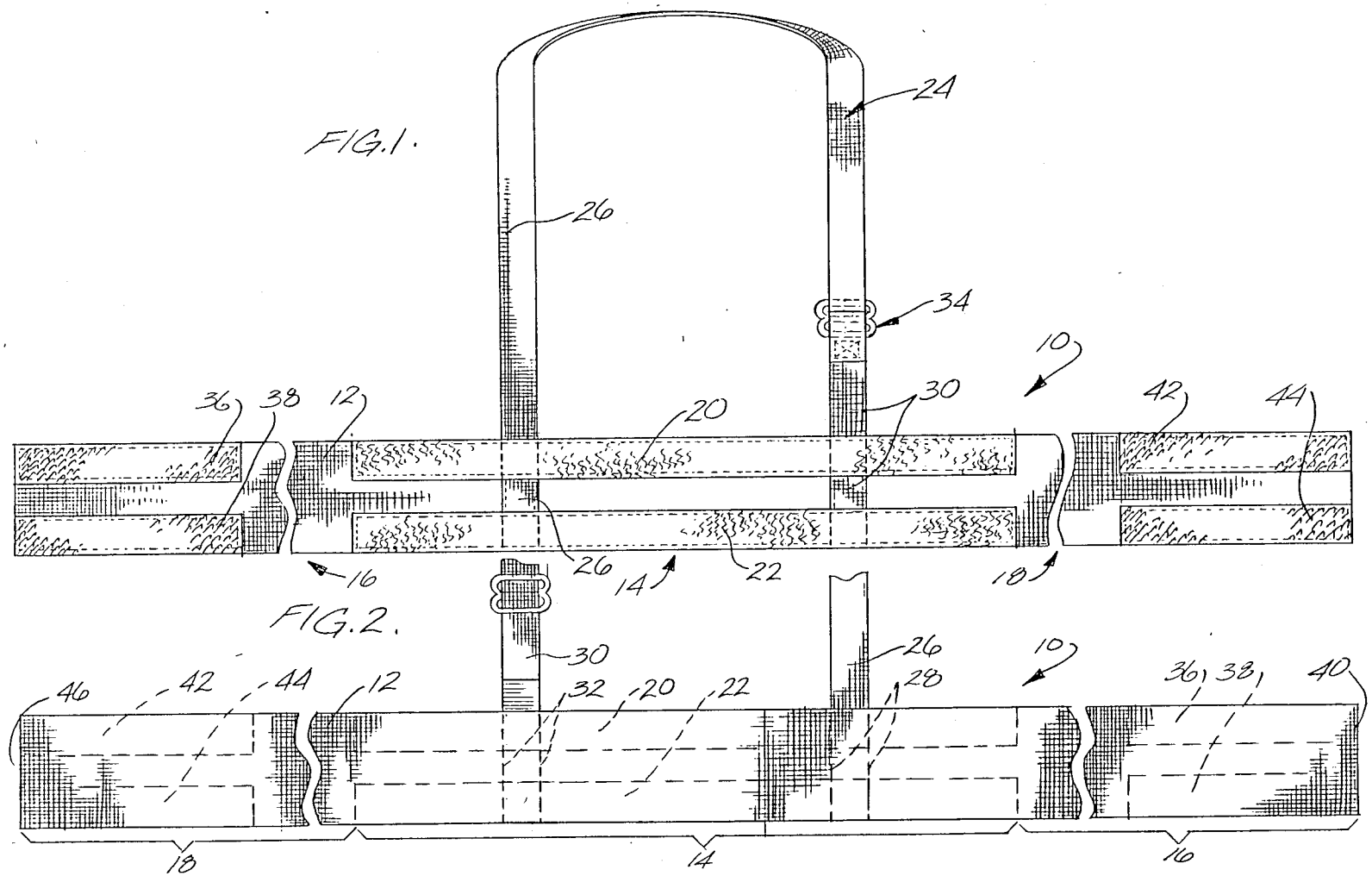
FIG. 1 is a front elevation view showing an arm locking device according to principles of this invention.
FIG. 2 is a fragmentary elevation view of the arm locking device taken from an opposite side from that shown in FIG. 1.

FIG. 1 illustrates a front elevation view of an arm locking device 10 for weightlifters according to principles of this invention. FIG. 2 illustrates the opposite side of the arm locking device shown in FIG. 1. As illustrated in these figures, the arm locking device includes an elongated flexible and foldable strap 12 which is substantially longer than its width and is preferably of uniform width from end to end. The strap is preferably made from a heavy duty woven nylon fabric so that the strap is flexible and foldable but is also axially stiff or essentially nonelastically stretchable in its axial direction. In one embodiment the strap 12 is approximately 52 to 56 inches long and has a width approximately 2½ to 3½ inches wide A preferred length is 54 inches and a preferred width is about three inches. Referring to the rear elevation view of FIG. 2, the elongated strap 12 preferably comprises a central region 14, a right end region 16, and a left end region 18. Each of these three sections of the strap extends for approximately one-third the total length of the strap. In an preferred embodiment the central region and each of the left and right regions is approximately 18 inches long.

A pair of elongated continuous narrow friction fasteners 20 and 22 are secured to the entire length of the central region 14 of the strap. These fasteners 20 and 22 are preferably secured so that they extend parallel to one another immediately inboard the upper edge and lower edge of the strap. In a preferred embodiment the frictional fasteners comprise a pile type of Velcro material.

An adjustable neck loop 24 is also secured to the central region 14 of the strap. The neck loop includes a long strap 26 extending upwardly away from the central region of the strap generally perpendicular to the top edge of the strap. The long neck strap 26 is rigidly fastened to the strap 12 by rows of stitching 28. The neck loop also includes a short neck strap 30 also extending perpendicularly away from the upper edge of the strap 12. The lower portion of the short neck strap 30 is rigidly affixed to the strap 12 by rows of stitching 32. The long and short portions 26 and 30 of the neck strap are preferably secured to the outer face of the strap 12 between the strap 12 and the overlying Velcro fasteners 20 and 22. The long neck strap 26 is sufficiently long to extend from the strap 12 and around the neck region of the weightlifter and then extend toward the short portion 30 of the neck strap to an adjustable ring fastener 34. This fastener adjusts the length of the loop formed by the long and short portions 26 and 30 of the neck loop. The ring fastener 34 is conventional. The resulting neck loop is adjusted to the size of the weightlifter and generally is sufficiently long so that the central region 14 of the strap 12 can overlie the chest region of the weightlifter during use, generally in the region of the biceps, with the loop extending upwardly and behind the weightlifter's neck for stabilizing the central portion 14 of the strap 12 in a generally horizontal position across the chest.

The right end portion 16 of the strap 12 includes a pair of short, continuous, elongated friction fasteners 36 and 38 These fasteners are preferably made from parallel strips of a Velcro hook type material, and these fastener strips extend parallel to one another immediately inboard the right end 40 of the strap 12. In one embodiment they extend for approximately six inches in length. At the opposite end of the strap 12, a pair of upper and lower elongated continuous friction fasteners 42 and 44 extend parallel to one another immediately inboard the left end 46 of the strap 12. In a preferred embodiment the fasteners 42 and 44 at the left end of the strap are also about six inches in length and comprise strips of velcro hook material.

Figure 3:
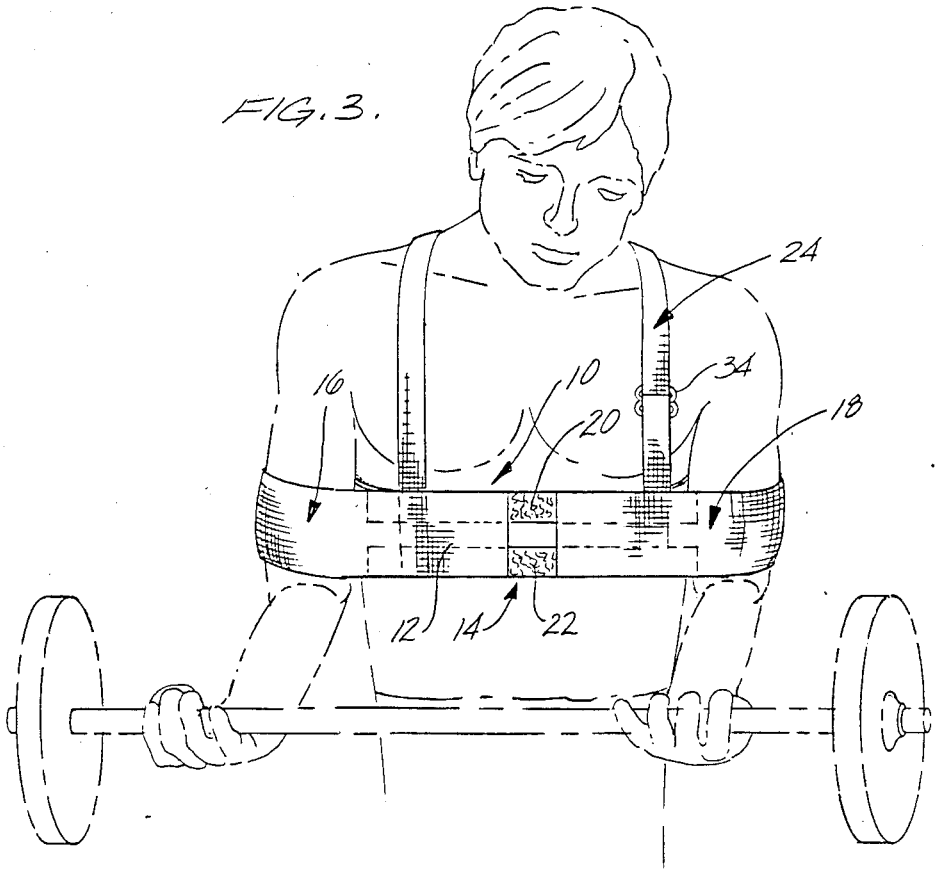
FIG. 3 is a perspective view illustrating the arm locking device during use.
Figure 4:
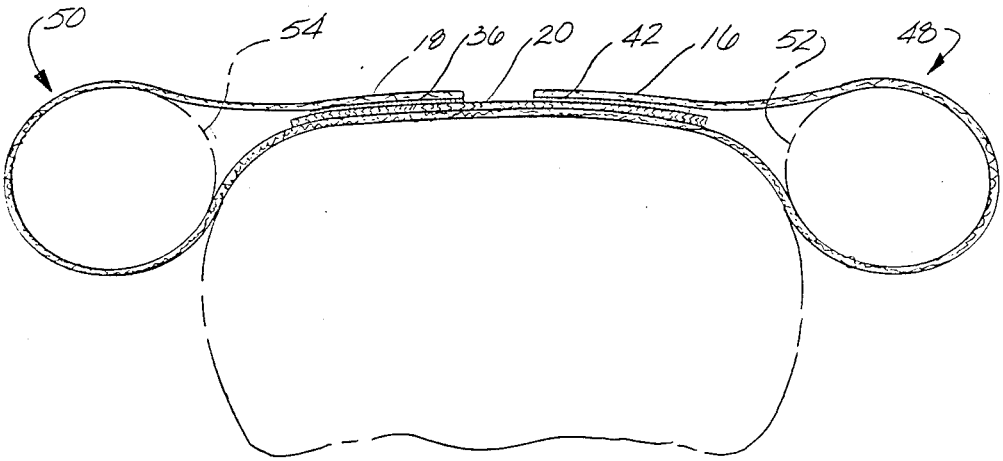
FIG. 4 is a semi-schematic top view shown enlarged and out of proportion for clarity to illustrate the use of the arm locking device.

FIGS. 3 and 4 illustrate use of the arm locking device. The central region 14 of the strap 12 is placed over the front of the chest region of the user and is stabilized on the chest region by first placing the adjusted neck loop 24 around the neck of the weightlifter. The left end portion 16 of the strap 12 is then wrapped around the left arm of the weightlifter, by extending the left end of the strap behind the left arm, i.e. between the left side of the chest and left elbow, behind the left triceps and then around the outside of the left arm and around the front of the biceps, with the left end portion of the strap then extending to an overlapping position on the central region 14 of the strap 12. Similarly, the right end portion 18 of the strap is wrapped around the right arm of the weightlifter by passing the right end of the strap between the right side of the chest region and the right arm, behind the right triceps and around the right arm, over the front of the right biceps, with the right end portion of the strap overlapping the central portion of the strap 12. The Velcro fasteners 36 and 38 at the right end of the strap are affixed to right end portions of the Velcro fasteners 20 and 22 that face outwardly from the central region of the strap. Similarly, the Velcro fasteners 42 and 44 at the left end of the strap are affixed to the left end portions of the cooperating Velcro fasteners 20 and 22 on the central portion of the strap. Once the strap is wrapped around the arms and then the ends of the straps are tightly affixed by the frictional fasteners so that the strap firmly holds both arms in contact with the sides of the body so as to prevent any significant outward movement of the elbows away from the sides of the weightlifter's body. This means of attachment is best illustrated schematically in FIG. 4 which shows a right loop 48 and a left loop 50 formed by the right and left end portions of the strap, respectively, as they fit around the right and left arms 52 and 54 of the weightlifter. This attachment of the arm locking device, being in the biceps region of the arms, leaves the forearms entirely free from any restraint so that arm exercises such as curls can be preformed without any resistance caused by the arm locking device. The strap 12 being substantially inflexible in length resists any tendency of the elbows to drift away from the sides of the weightlifter's body during use. Because of the flexibility of the strap, any pressure applied to the body from weightlifting exercises does not create discomforting pressure on the chest or arms of the weightlifter; while the loops 48 and 50 which extend entirely around the biceps regions resist any tendency for the arms to move outwardly and remain rigidly fixed in place against the sides of the body (because of the axial inflexibility of the strap) during the exercise. Thus, the weightlifting exercise can be isolated on specific muscles because of this means for controlling the positions of the arms during use. In addition, the flexibility of the arm locking device makes it possible for use by women weightlifters and also makes it possible for the device to easily be folded into a small size to be easily carried in a gym bag.

What is claimed is:

1. A arm locking device for use by weightlifters comprising:

An elongated flexible and foldable strap which is substantially non-stretchable in its axial dimension, the strap having a central portion for overlying the chest region of a weightlifter; a left end portion long enough to wrap around the left arm of the weightlifter by extending between the chest and the left elbow, behind the left triceps, over the left biceps, and then to an overlapping position on the central portion of the strap; and a right end portion long enough to wrap around the right arm of the weightlifter by extending between the chest and the right elbow, behind the right triceps, over the right biceps, and then to an overlapping position on the central portion of the strap;

a neck loop rigidly affixed to spaced apart positions on the central portion of the strap substantially equidistantly between the ends of the strap for extending away from the strap a sufficient distance to wrap around the neck of the weightlifter during use of the arm locking device;

elongated friction fastening means on the central portion of the strap extending substantially parallel to the axial dimension of the strap;

left fastening means comprising an elongated friction fastener on the left end portion of the strap spaced from the fastening means on the central portion of the strap and extending generally parallel to the axial dimension of the strap for providing an infinitely adjustable and axially continuous means of attachment to the friction fastening means on the central portion of the strap to securely hold the left end portion of the strap in a fixed position wrapped in a loop of adjustable size around the left arm of the weightlifter; and right fastening means comprising an elongated friction fastener on the right end portion of the strap spaced from the fastening means on the central portion of the strap and extending generally parallel to the axial dimension of the strap for providing an infinitely adjustable and axially continuous means of attachment to the friction fastening means on the central portion of the strap to securely hold the right end portion of the strap in a fixed position wrapped in a loop of adjustable size around the right arm of the weightlifter, so that the left and right arms of the weightlifter are held in a locked position with the fastened end portions of the non-stretchable strap keeping the elbows of the left and right arms close to the body by resisting outward movement of the left and right arms as weight is being lifted, with the flexibility of the strap in its fastened position being sufficient to offer substantially no resistance to the weightlifting exercise.

2. Apparatus according to claim 1 in which the central portion of the strap extends for about one-third the total length of the strap, and the left and right end portions of the strap each extend about one-third the total length of the strap.

3. Apparatus according to claim 2 in which the fastening means on the central portion of the strap extend substantially the entire axial dimension of the central portion of the strap, and in which the left and right fastening means are each secured adjacent the outer ends of the strap and extend inwardly for a portion of the length of the left and right end portions of the strap.

4. Apparatus according to claim 1 in which the fastening means on the central portion of the strap comprise elongated infinitely adjustable friction fastener extending for about one-third the length of the central portion of the strap.

5. Apparatus according to claim 1 in which the neck loop includes means for adjusting the length of the loop.

6. Apparatus according to claim 1 in which the friction fastening means on the central portion of the strap comprise a pair of spaced apart upper and lower generally parallel elongated friction fasteners; in which the left fastening means comprise a pair of spaced apart upper and lower generally parallel elongated friction fasteners; and in which the right fastening means comprise a pair of spaced apart upper and lower generally parallel elongated friction fasteners.

7. Apparatus according to claim 6 in which the upper and lower fastening strips on the central portion, the right end portion and the left end portion of the strap all extend closely adjacent to the upper and lower marginal edges of the strap.

8. Apparatus according to claim 1 in which the left and right end portions of the strap, between the left and right fastening means and the fastening means on the central portion of the strap, are substantially free of said friction fastening means for an axial dimension sufficient for the strap to wrap substantially around the left and right arms of the weightlifter.

9. An arm locking device for use by weightlifters comprising:

an elongated flexible and foldable strap which is substantially non-stretchable in its axial dimension, the strap having a central portion for overlying the chest region of a weightlifter; a left end portion long enough to wrap around the left arm of the weightlifter by extending between the chest and the left elbow, behind the left triceps, over the left biceps, and then to an overlapping position on the central portion of the strap; and a right end portion long enough to wrap around the right arm of the weightlifter by extending between the chest and the right elbow, behind the right triceps, over the right biceps, and then to an overlapping position on the central portion of the strap;

in which the central portion of the strap extends for about one-third the total length of the strap, and the left and right end portions of the strap each extend for about one-third the total length of the strap;

a neck loop rigidly affixed to spaced apart positions on the central portion of the strap substantially equidistantly between the ends of the strap for extending away from the strap and wrapping around the neck of the weightlifter during use of the arm locking device;

elongated friction fastening means on the central portion of the strap extending generally parallel to the axial dimension of the strap;

left fastening means comprising an elongated friction fastener on the left end portion of the strap extending inwardly from the left end of the strap generally parallel to the axial dimension of the strap for providing an infinitely adjustable and axially continuous means of attachment to the friction fastening means on the central portion of the strap, to securely hold the left end portion of the strap in a fixed position wrapped in a loop of adjustable size around the left arm of the weightlifter, the left fastening means being spaced axially from the fastening means on the central portion of th strap so that the left end portion of the strap which loops around the left arm of the weightlifter is substantially free of said friction fastening means; and right fastening means comprising an elongated friction fastener on the right end portion of the strap extending inwardly from the right end of the strap generally parallel to the axial dimension of the strap for providing an infinitely adjustable and axially continuous means of attachment to the friction fastening means on the central portion of the strap, to securely hold the right end portion of the strap at a fixed position wrapped in a loop of adjustable size around the right arm of the weightlifter, the right fastening means being spaced axially from the fastening means on the central portion of the strap so that the right end portion of the strap which loops around the right arm of the weightlifter is substantially free of said friction fastening means, whereby the left and right arms of the weightlifter are held in a locked position with the fastened end portions of the non-stretchable strap keeping the elbows of the left and right arms close to the body by resisting outward movement of the left and right arms as weight is being lifted, with the flexibility of the strap in its fastened position being sufficient to offer substantially no resistance to the weightlifting exercise.

* * * * *